US005372492A

United States Patent [19]

Yamauchi

[11] Patent Number: 5,372,492

[45] Date of Patent: Dec. 13, 1994

[54] APPARATUS FOR PRODUCING ICE VESSEL

[76] Inventor: Keijirou Yamauchi, 1-8-18, Katakura, Kanagawa-ku, Yokohama-shi, Kanagawa-ken, Japan

[21] Appl. No.: 25,181

[22] Filed: Mar. 2, 1993

[30] Foreign Application Priority Data

Oct. 26, 1992 [JP] Japan ..... 4-287747
Jan. 22, 1993 [JP] Japan ..... 5-009453

[51] Int. Cl.[5] ..... B29C 43/50; B29C 43/52

[52] U.S. Cl. ..... 425/139; 425/258; 425/407; 425/408; 425/422; 425/436 R; 425/436 RM; 425/444; 249/79

[58] Field of Search ..... 425/444, 436 RM, 437, 425/258, 422, 407, 552, 139, 165, 408, 436 R; 249/67, 79; 62/321, 354, 64

[56] References Cited

U.S. PATENT DOCUMENTS

| | | | |
|---|---|---|---|
| 4,118,168 | 10/1978 | Rees et al. | 425/436 R |
| 4,139,177 | 2/1979 | Hanning | 425/552 |
| 4,205,950 | 6/1980 | Suss et al. | 425/552 |
| 4,249,881 | 2/1981 | Oppl et al | 425/259 |
| 4,571,320 | 2/1986 | Walker | 425/139 |
| 4,686,076 | 8/1987 | Dromigny et al. | 425/444 |
| 4,708,621 | 11/1987 | Schmidgall et al. | 425/259 |
| 4,755,128 | 7/1988 | Alexander et al. | 425/422 |
| 4,781,571 | 11/1988 | Heindl et al. | 425/444 |
| 4,795,124 | 1/1989 | Nagai | 425/436 R |
| 5,037,287 | 8/1991 | Hirai | 425/422 |
| 5,181,456 | 1/1993 | Theys et al. | 425/444 |

FOREIGN PATENT DOCUMENTS

| | | | |
|---|---|---|---|
| 2945706 | 5/1981 | Germany | 425/139 |
| 61-263722 | 11/1986 | Japan | 425/139 |
| 63-194271 | 12/1988 | Japan . | |
| 893553 | 12/1981 | U.S.S.R. | 425/436 R |
| 1426822 | 9/1988 | U.S.S.R. | 425/436 RM |

*Primary Examiner*—Khanh Nguyen
*Attorney, Agent, or Firm*—Quarles & Brady

[57] ABSTRACT

An apparatus for producing ice vessels for use in serving fresh foods is disclosed. The apparatus includes a female die with a male die opposite to the female die. The female die has a hole at the bottom thereof through which a pin can be raised and lowered by means of an elevator device. An automatic ice crusher is located relative to a chute box for feeding ice pieces into the female die. The chute box has an outlet located above the female die and an inlet located below the ice crusher for receiving ice from the ice crusher. A carrier-arm device is movable back and forth to transport molded ice vessels from the female die. A transporting outlet chute serves to transport the molded ice vessels, the outlet chute being inclined for permitting the molded ice vessels to slide thereon. The device is further characterized by having the carrier-arm device include holding arms capable of moving toward and away from each other along the sides of the female die. The chute box is movable in a synchronized manner with respect to the transporting of the molded ice vessels to have its outlet directed for feeding ice into the female die upon removable of an ice vessel from the female die.

2 Claims, 10 Drawing Sheets

APPARATUS FOR PRODUCING ICE VESSEL

BACKGROUND OF THE INVENTION (a) Field of the Invention

The present invention relates to an apparatus for forming ice pieces into ice vessels through the use of male and female dies.

(b) Description of Prior Art

In the past, an apparatus for producing ice vessel for vegetable salad and the like has been proposed in Japanese Utility Model Publication No.63-194271, which comprises; a first male die, a female die having diameter longer than the diameter of the first male die so that it may be fitted in the male die, and the second male die having a convex portion for depressing ice pieces filled in the female die.

Such conventional prior art as described above can not be utilized for mass production of ice vessels since the ice pieces must be mannually filled to be formed into the ice vessel.

SUMMARY OF THE INVENTION

Accordingly, it is an object of the present invention to provide an apparatus for automatically producing ice vessels. It is another object of the present invention to provide an apparatus for automatically transporting the produced ice vessels. In accordance with a major feature of the present invention, there is provided a structure for an ice vessel producing apparatus, including: male and female dies opposed to each other; a through hole formed at the bottom of the female die; a pushing-out pin raised or lowered in the through hole by an elevator device; a chute box provided for feeding ice pieces to the female die; a carrier arm device provided beside a side of the female die, and the carrier arm device being movable back and forth to transport the produced ice vessels.

BRIEF DESCRIPTION OF THE DRAWINGS

Other objects, features and advantages of the invention will be apparent to those skilled in the art from the following description of the preferred embodiment of the invention, wherein reference is made to the accompanying drawings, of which.

DESCRIPTION OF A PREFERRED EMBODIMENT

Hereinafter is described the first embodiment of the present invention with reference to FIGS. 1 to 5.

Figure 1:
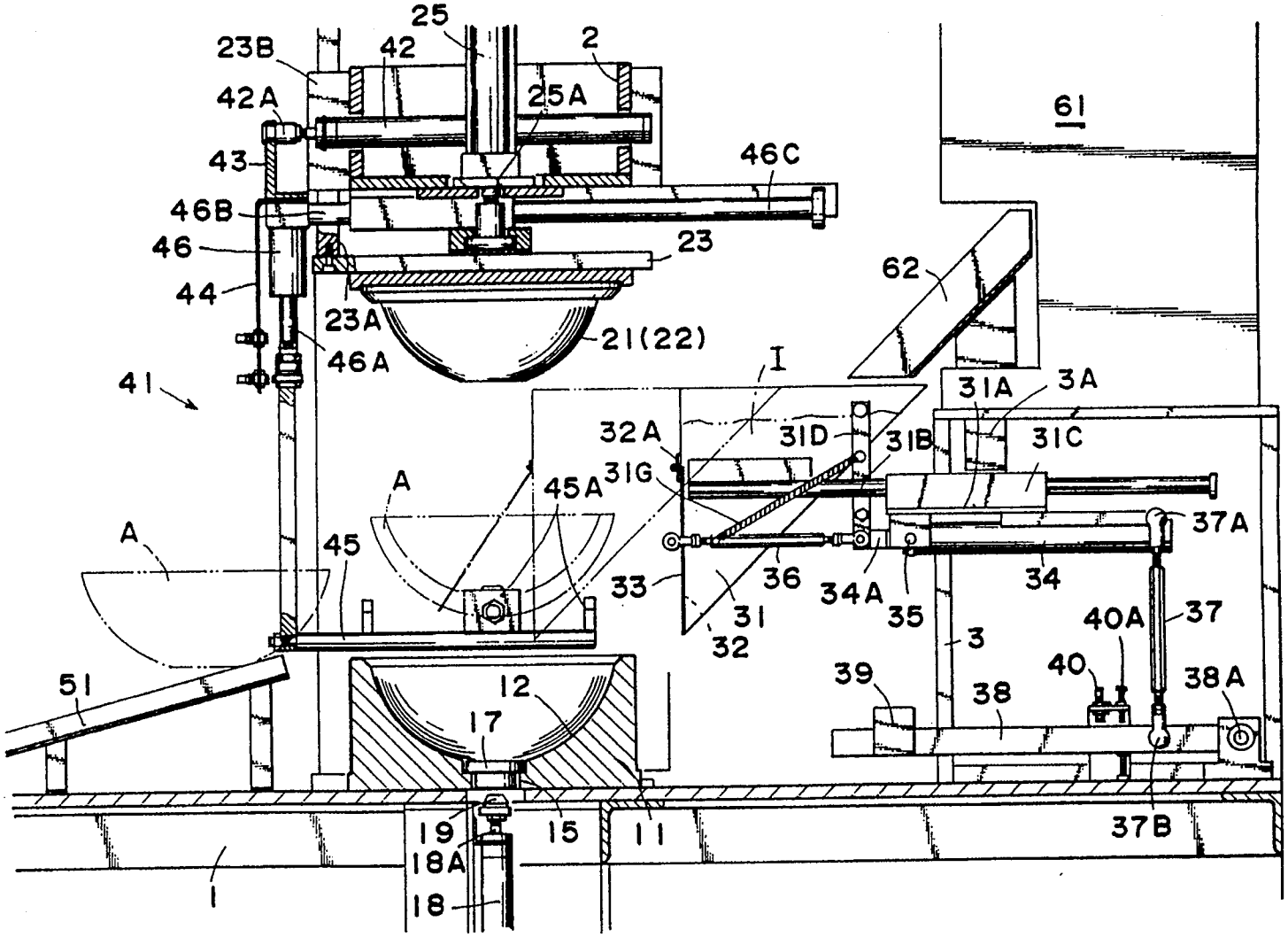
FIG. 1 is a sectional view showing the first embodiment of the present invention.
Figure 2:
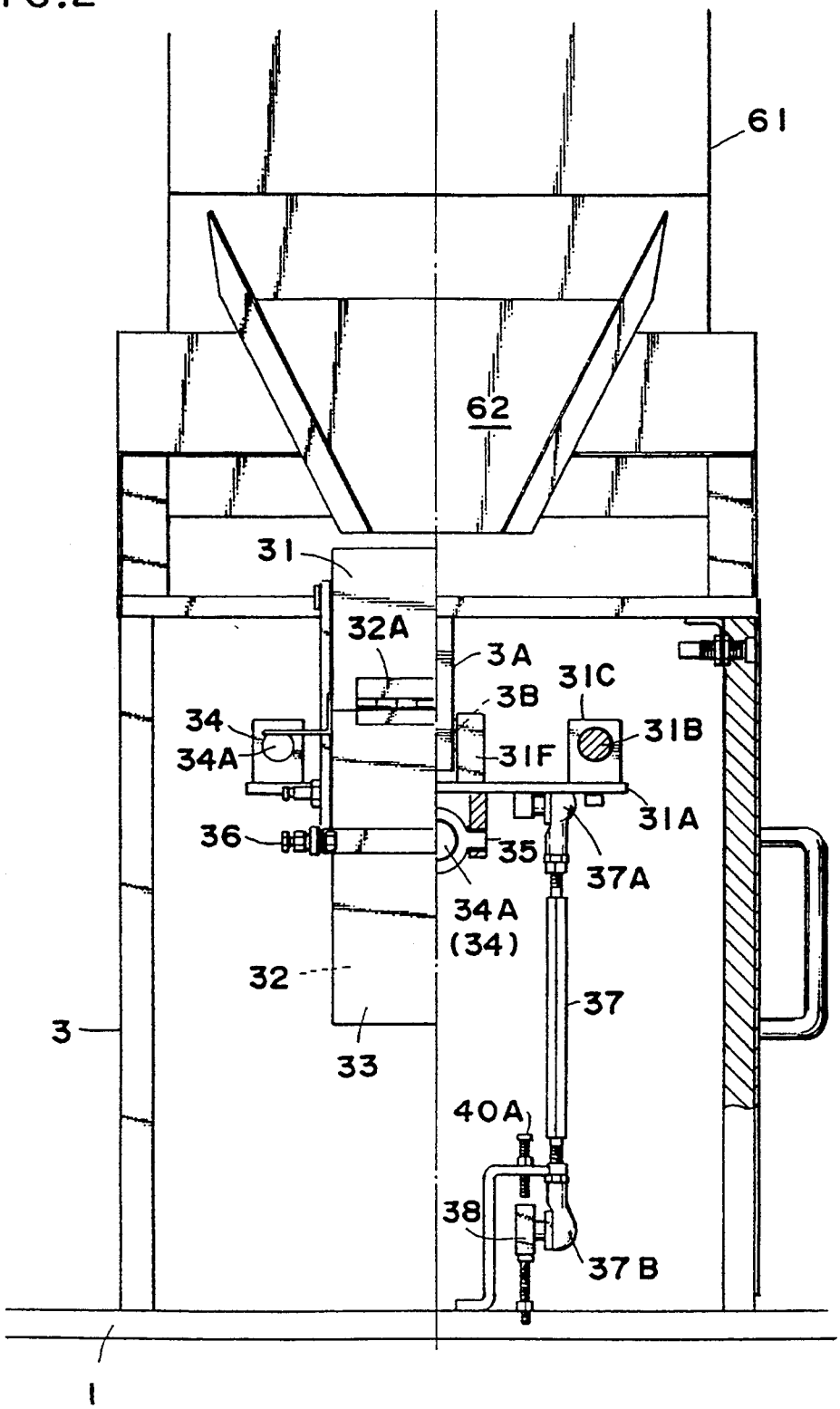
FIG. 2 is a detailed partial cross section and broken view showing a chute box of the embodiment of the invention.
Figure 3:
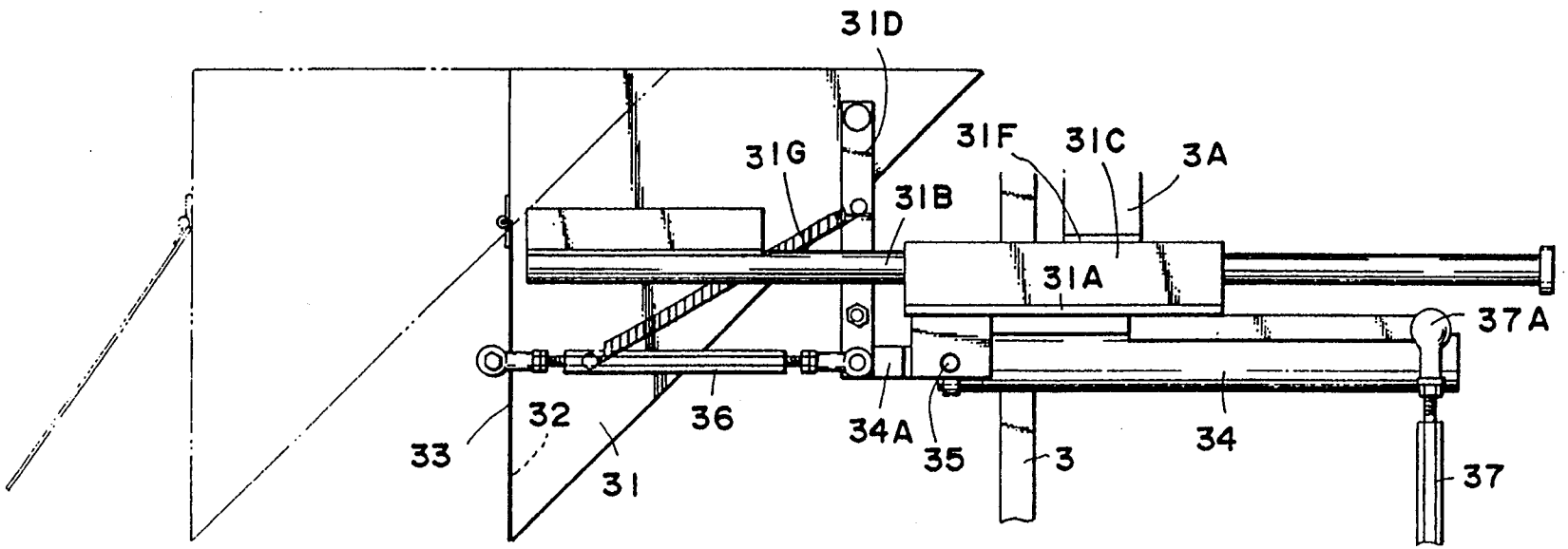
FIG. 3 is a front view showing one of the embodiments of the invention.

As shown in FIG. 1, on base frame 1 is secured a female die 11. Above and opposite to the female die 11 is provided an elevator male die 21. Beside one side of the elevator male die 21 and the female die 11 is provided chute box 31 for supplying ice pieces I into the female die 11. Beside the other side of the elevator male die 21 and the female die 11 is provided a carrier arm device 41 for holding and transporting ice vessels formed by depressing the male die 11 to into the female die 21. Outside the carrier arm device 41 is provided a transporting chute 51.

Figure 5:
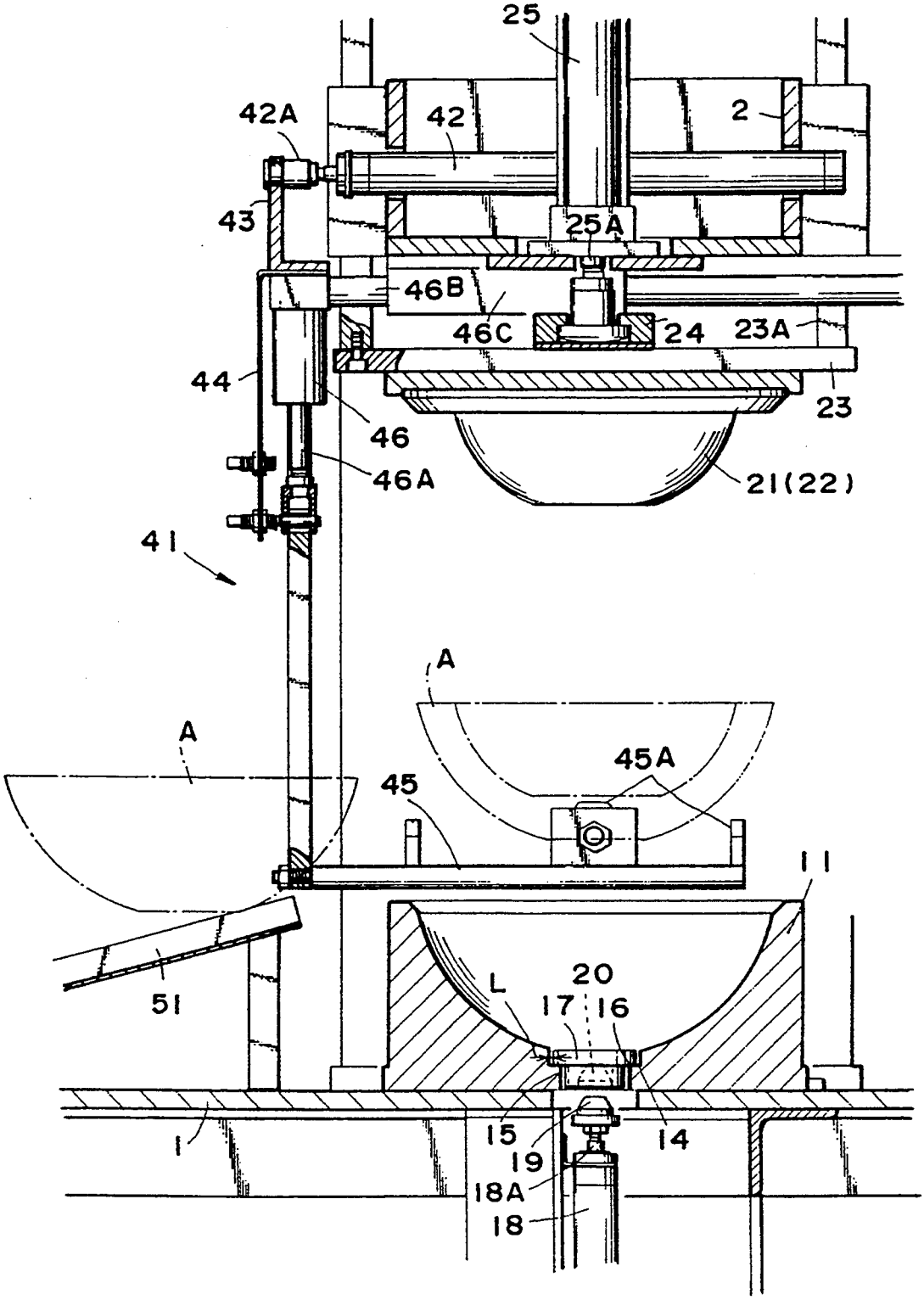
FIG. 5 is a sectional view around the male and female die showing one of the embodiments of the invention.

On the upper surface of the female die 11 is formed a hemispherical concave portion 12, which is, for example, surface-treated with fluorine. At the deepest part of the hemispherical concave portion 12 is longitudinally provided a through hole 15 having stepped portion 14. In the through hole 15 is provided pushing-out pin 17 with a stepped portion 16 hung on the stepped portion 14. Below the pushing-out pin 17 is provided air pressure cylinder device 18 used as an elevator device. As shown in FIG. 5, at the upper end of rod 18A of the cylinder, device 18 is provided truncated protrusion 19, which is pushed into truncated concave portion 20 formed in the bottom surface of pushing-out pin 17 so that ice vessels A may be raised to be carried out of female die 11. The pushing-out pin 17 and through hole 15 are so formed that there is provided a small clearance "L" when the former is fitted in the latter.

On the lower surface of the male die 21 is formed hemispherical convex portion 22, which is, for example, surface-treated with fluorine. To the upper surface of the male die 21 is fixed flange 24 with mounting plate 23 placed between them. To upper frame 2 provided above the base frame 1 is vertically fixed an air pressure cylinder 25, and to the end of rod 25A of the cylinder device 25 is connected the flange 24, so that male die can be depressed into female die 11 by actuating the cylinder device 25. As shown in FIG. 5, reference numeral 23A designates elevator guide rod, and numeral 23B indicates a cylindrical member for supporting the elevator guide rod. Numeral 26 designates a switch for detecting the upper elevating limit of the male die 21, and numeral 27 designates a switch for detecting the lower elevating limit of the male die 21. The chute box 31 is provided with an upper aperture and vertical outlet 32, in which there are provided a gate plate 33 and hinge 32A for opening and closing the vertical outlet 32.

In the back of the chute box 31 is provided a slide guide rod 31B which can reciprocatively move forward or backward sliding through cylindrical member 31C fixed to slide plate 31A. An air pressure cylinder device 34 is connected to hinge axis 35 in such a manner that it can be slightly rotated around hinge axis 35. The gate plate 33 is connected to rod 36 of yoke type, which is rotatably connected to the rod 34A. The upper part of supporting section 31F, shown in FIGS. 2 to 3 vertically provided and fixed to the slide plate 31A, is connected to supporting rod 3A of side frame 3 by shaft 3B so that the supporting section 31F may be suspended and be rotated. Reference numeral 31G indicates a spring provided for linking rod 31D, for connecting rod 34A to chute box 31, with the rod 36 of yoke type.

With the structure thus made, when rod 34A of the cylinder device 34 is extended, the chute box 31 is moved forward so that the gate plate 33 is opened. At the back part of the plate 31A is slidably provided upper end 37A of elevator rod 37, while the lower end 37B thereof is rotatably connected to lever 38, which is provided with fulcrum 38A at its back part and is slidably provided with balance weight 39 at its front part. Switch 40, which will be on and off corresponding to the rotation of the lever 38, is provided beside lever 38. Reference numeral 40A indicates a stop for regulating the rotation of lever 38.

The carrier arm device 41 includes an air cylinder device 42 horizontally fixed to the upper frame 2. A movable frame 43 is provided at the end of rod 42A of the air cylinder device 42. Pendulous arms 44 have the upper ends rotatably connected to said movable frame 43. Holding arms 45 extending toward the female die 11 are respectively connected to the lower ends of the pendulous arms 44. Reference numeral 45A designates protrusions provided to hold the ice vessel A.

Figure 4:
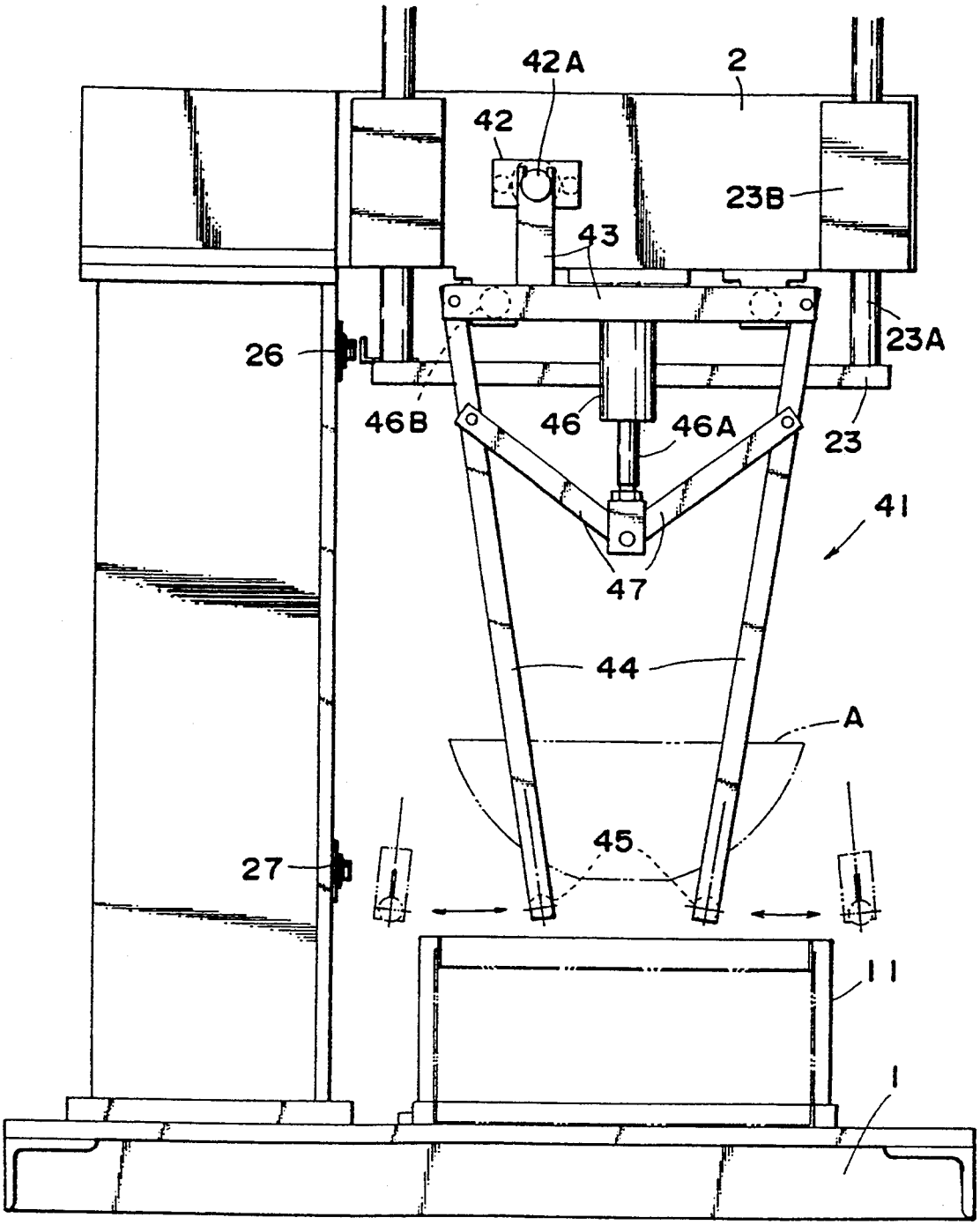
FIG. 4 is a side view showing a carrier device of the invention.

As shown in FIG. 4, in the center of the movable frame 43 is vertically mounted air pressure cylinder device 46 to move the pendulous arms 44 toward and away from each other. To the rod 46A of the cylinder device 46 is rotatably connected one end of interlocking arms 47, while the other end of each arm 47 is rotatably connected to a respective pendulous arm 44.

Reference numeral 46A indicates a slide guide rod, which is slidably supported by cylindrical supporting member 46C shown in FIGS. 1 and 5 fixed to the upper frame 2. Numeral 61 indicates an automatic ice crusher mounted on the side frame 3 for making ice pieces are fed through outlet 62 to the upper aperture of the chute box 31.

Hereinafter will be explained the operation of the present invention. When a starting switch (not shown) is turned on, ice pieces I are fed from outlet chute 62 of automatic ice crusher 61 into chute box 31. Sequential filling of said ice pieces I into chute box 31 causes the weight In chute box 1 to generally increase, which causes chute box 31 to rotate in an anti-clockwise direction around shaft 3B together with slide plate 31A. This causes slide plate 31A to be lifted up to raise elevator rod 37, which causes lever 38 to rotate clockwise so that switch 40 is turned on. Briefly explaining this operating system, switch 40 will not be turned on while the weight of ice pieces in chute box 31 remains comparatively light, but will be turned on when the weight reaches a predetermined level, which can be understood in view of the balance of the moment on the side of slide plate 31A and the moment on the side of lever 38 having balance weight 39. When switch 40 is turned on, cylinder device 34 starts to extend rod 34A so that chute box 31 moves forward together with slide plate 31A until the lower end of outlet 32 is positioned above the concave portion 12 of female die 11. At that time, gate plate 33 is opened to feed ice piece I into the concave portion 12 of female die 11. Thereafter, gate plate 33 is closed by cylinder device 34 actuated by a timer device (not shown) and the like, and chute box 1 moves backward to be supplied with a new predetermined amount of ice pieces I, in preparation for the next production. The male die 21 is then lowered to the position of switch 27 which is shown in FIG. 4 and provided for detecting the lower elevating limit of male die 21, by extending rod 25A of cylinder device 25 until the convex portion 22 is fitted into concave portion 12. The ice pieces I in the concave portion 12 are thereby depressed to be formed into a hemispherically shaped ice vessel.

This producing process is inevitably followed by removal of trapped air, which in this embodiment is solved by allowing the air to be removed by passing through clearance "L" between through hole 15 and pushing-out pin 17, and the small clearance between stepped portions 14 and 16.

After producing ice vessel A in above-described manner, rod 25A is raised to raise male die 21 up to the position of switch 26, provided for detecting the upper elevating limit of male die 21. Thereafter, rod 18A is extended by cylinder device 18 in order to raise protrusion 19, thereby causing pushing-out pin 17 to be pushed upward. Consequently, ice vessel A is raised with the protrusion 17 supporting from below. While the ice vessel A is raised in this manner, rod 42A is retrieved by cylinder device 42, so that laterally paired holding arms 45 are positioned beside both sides of the bottom portion of the ice vessel A, which is illustrated in FIG. 5. In this case, as rod 46A is extended by cylinder device 46, the distance between the two pendulous arms 44 linked by interlocking arms 47 is generally decreased. Consequently, the distance between the two lower ends of the laterally paired holding arms 45 becomes narrower than the length corresponding to the diameter of said ice vessel A. Then rod 18A is lowered by cylinder device 18 together with said ice vessel A, which is to be positioned onto said paired holding arms 45. Thereafter, rod 42A is extended by cylinder device 42 until the holding arms 45 and pendulous arms 44 are positioned in the upper end of outlet chute 51, as illustrated in FIG. 5. Rod 46A is then raised by cylinder device 46 to widen the distance between two holding arms 45, so that ice vessel A falls down for a short distance to be placed on the outlet chute 51. Thereafter, the ice vessel A is transported by sliding along the slope of the outlet chute 51, to be presented as a dish for vegetable salad or raw food such as "SASHIMI" or fruit.

Hereinafter, the second embodiment of the present invention will be explained with reference to FIGS. 6 to 9, in which the same portions with those of the first embodiment are designated as the same numerals, and their repeated detail description will be omitted.

On base frame 1 is secured female die 11, above and opposite to which is provided male die 21 such that the male die can be raised and lowered. Beside the upper side between the male die 21 and female die 11 is provided chute box 70 for supplying the female die 11 with ice pieces I. Beside the lower side between the male die 21 and female die 11 is provided carrier arm device 41A for holding and carrying away produced ice vessels, which are to be transported sliding along on transporting chute 51 inclined to the horizontal plane.

Figure 10:
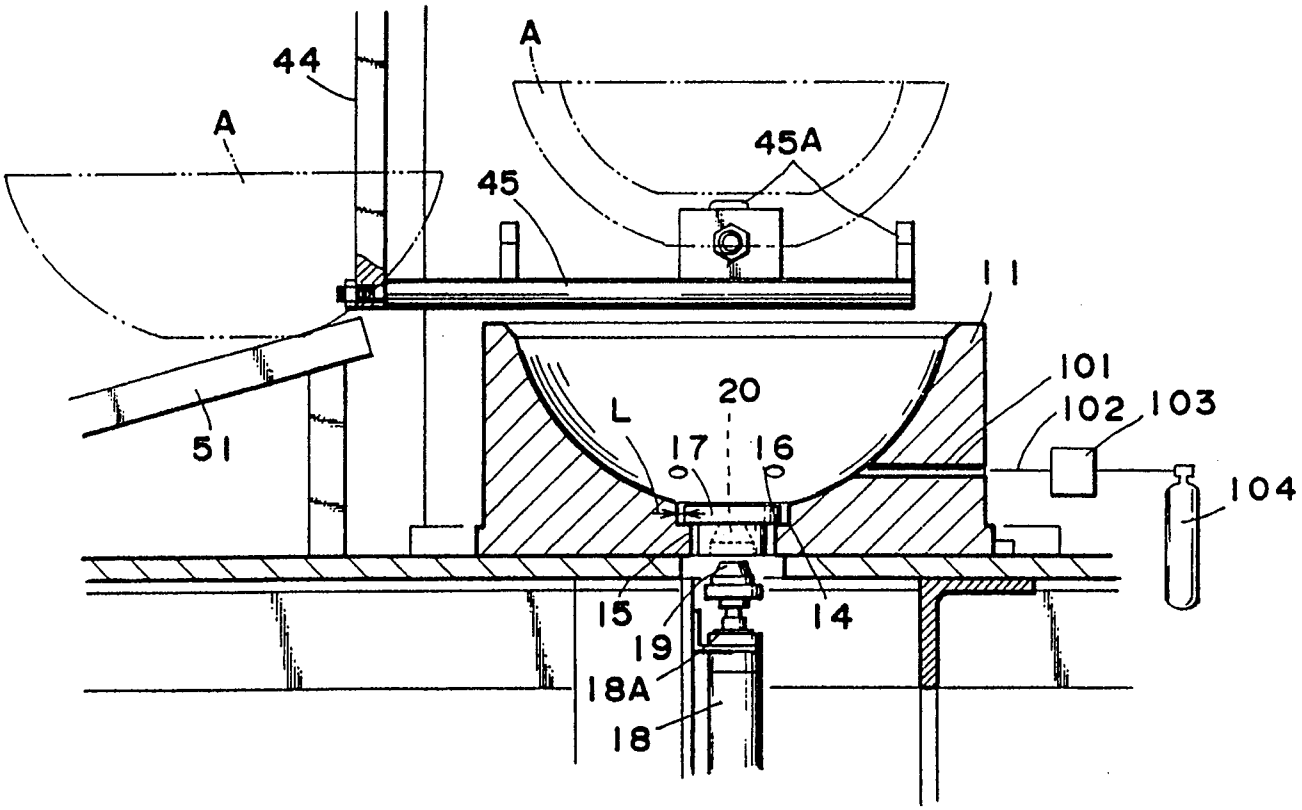
FIG. 10 is a sectional view showing the third embodiment of the present invention.

The chute box 70 is a rectangular box provided with an upper aperture as an inlet port and side-door 70B as an outlet port 70A. The side-door 70B is provided with pin 70C in the upper portion. At the front part of the chute box 70 is erected block wall 70E such that the block wall 70E is positioned opposite to supply port 62A of automatic ice crusher device 61 to prevent ice pieces I from spilling out of the chute box 70. The chute box 70 is mounted on horizontal plate 72 which is fixed and supported by legs 71 above the base frame 1. Approximately in the middle of the front part of the horizontal plate 72 is mounted lever 73, which is reciprocatively moved up and down with respect to fulcrum shaft 73A. Half crossed rod 74 is connected to the end of the lever 73 such that they are orthogonal to each other. To the end of the half crossed rod 74 is mounted roller 74A so that bottom plate 70D of said chute box 70 may slide. In the middle of said horizontal plate 72 is axially horizontally provided roller 75 having grooves 75A around the periphery thereof. The roller 75 is rotatably mounted to mounting seat 75B, so that bar 76 secured in the center of bottom plate 70D of the chute box 70 is capable of sliding on the grooves 75A. On the horizontal plate 72 is mounted proximity detector 77 facing the middle position between fulcrum shaft 73A and roller 75 to detect the position of the chute box 70. The switch of said proximity detector 77 is not depressed by lever 73 while chute box 70 is kept horizontal without predetermined amount of ice pieces 1 in said chute box 70, as shown in FIG. 10. On the other hand, the switch thereof is depressed by lever 73 either when chute box 70 is filled with a predetermined amount of ice pieces I, or after female die 11 is supplied therewith.

Along the lower edge of outlet port 70A of the chute box 70 is provided rod 78 to drive the chute box 70 back and forth, and projecting piece 80 of the rod 78 is rotatably connected to shaft 79 on both sides of outlet port 70A of said chute box 70. To the end of rod 78 is connected the upper end of rocking arm 81 provided obliquely above the front part of the base frame 1. With the lower end of said rocking arm 81 is linked one end of rotation shaft 82 in a right-angled manner. With the other end of the rotation shaft 82 is connected air pressure cylinder device 83 provided for rotation drive. To support the rotation shaft 82 is provided supporting member 84, which is rotatably penetrated by the rotation shaft 82. Additionally, stop 85 for height control is screwed into the end of the lever 73, and a pair of stop 87, also for height control, are screwed from both sides of projecting piece 86, which is fixed to one of the ends of the rotation shaft 82 nearer to the cylinder device 83, into the horizontal plate 72. The actuation of said air pressure cylinder device 83 allows the angle of elevation of the rocking arm 81 to change from nearly 35 degrees (shown in FIG. 6) to nearly 10 degrees (shown in FIG. 7). The arm 81 is to be returned to the initial position and the process is to be repeated by controlling the air pressure cylinder device 83. Where necessary, to the lever 73 may be mounted a balance weight (not shown).

Figure 6:
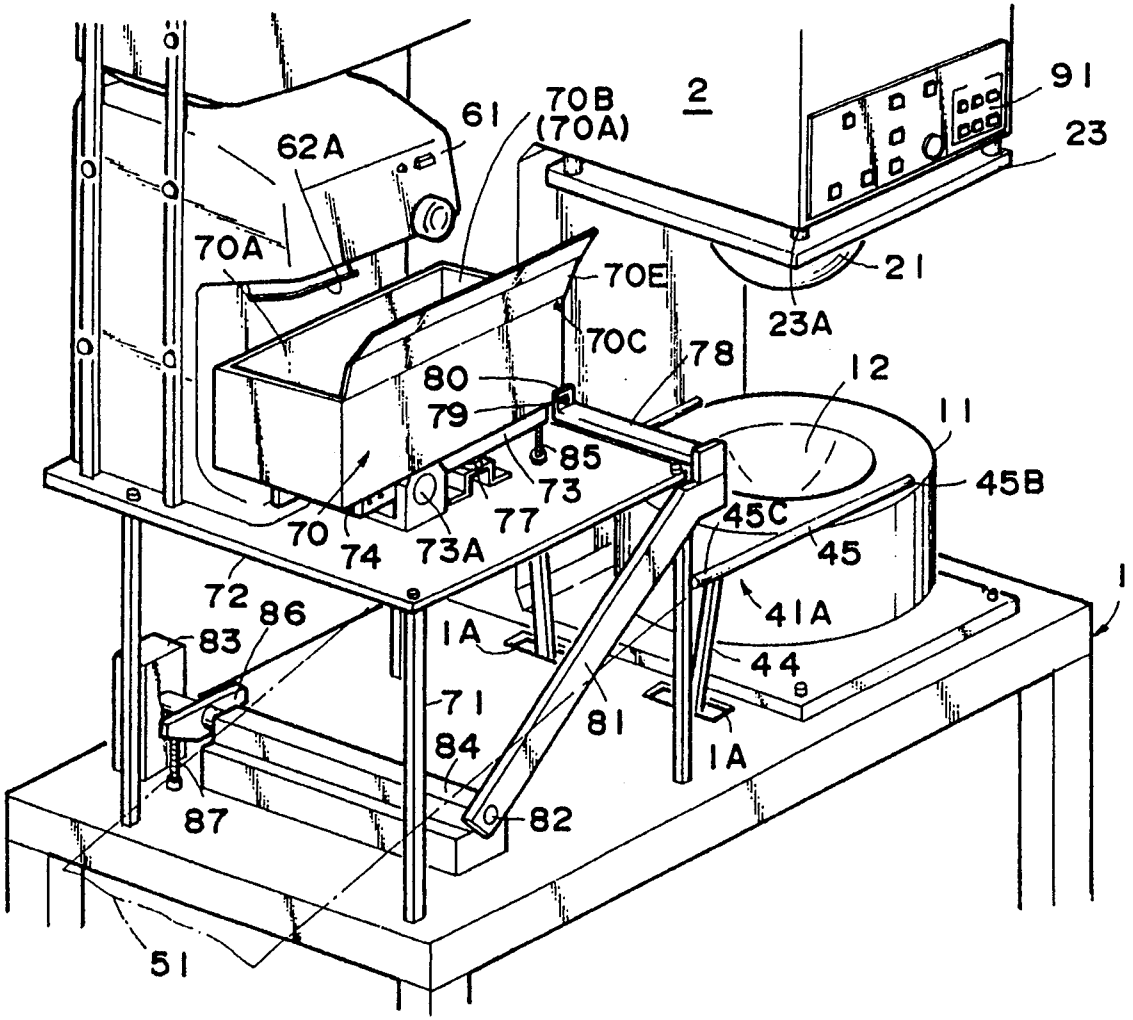
FIG. 6 is a perspective view showing the chute box of the second embodiment which is kept horizontal.
Figure 7:
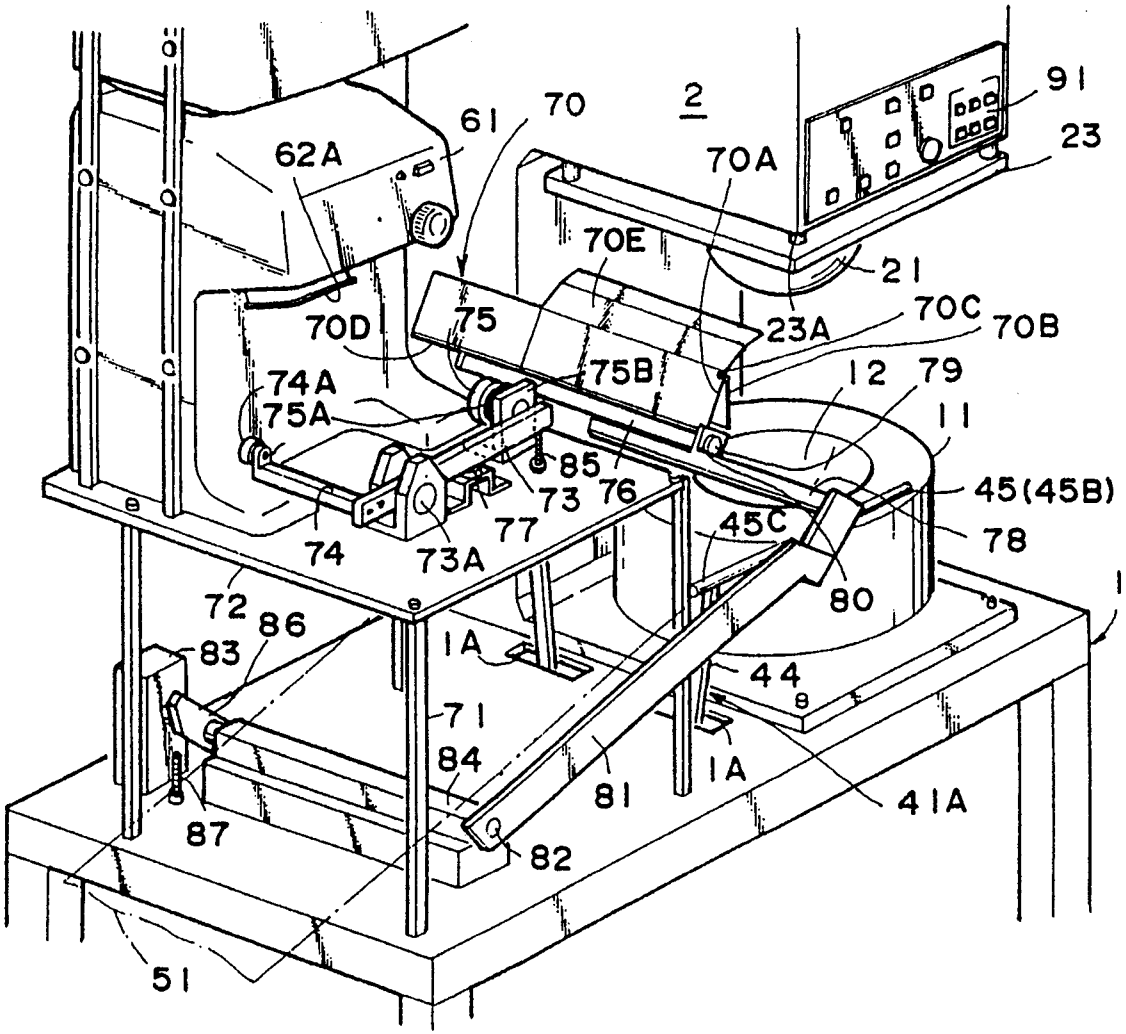
FIG. 7 is a perspective view showing the chute box of the second embodiment which is kept oblique.
Figure 8:
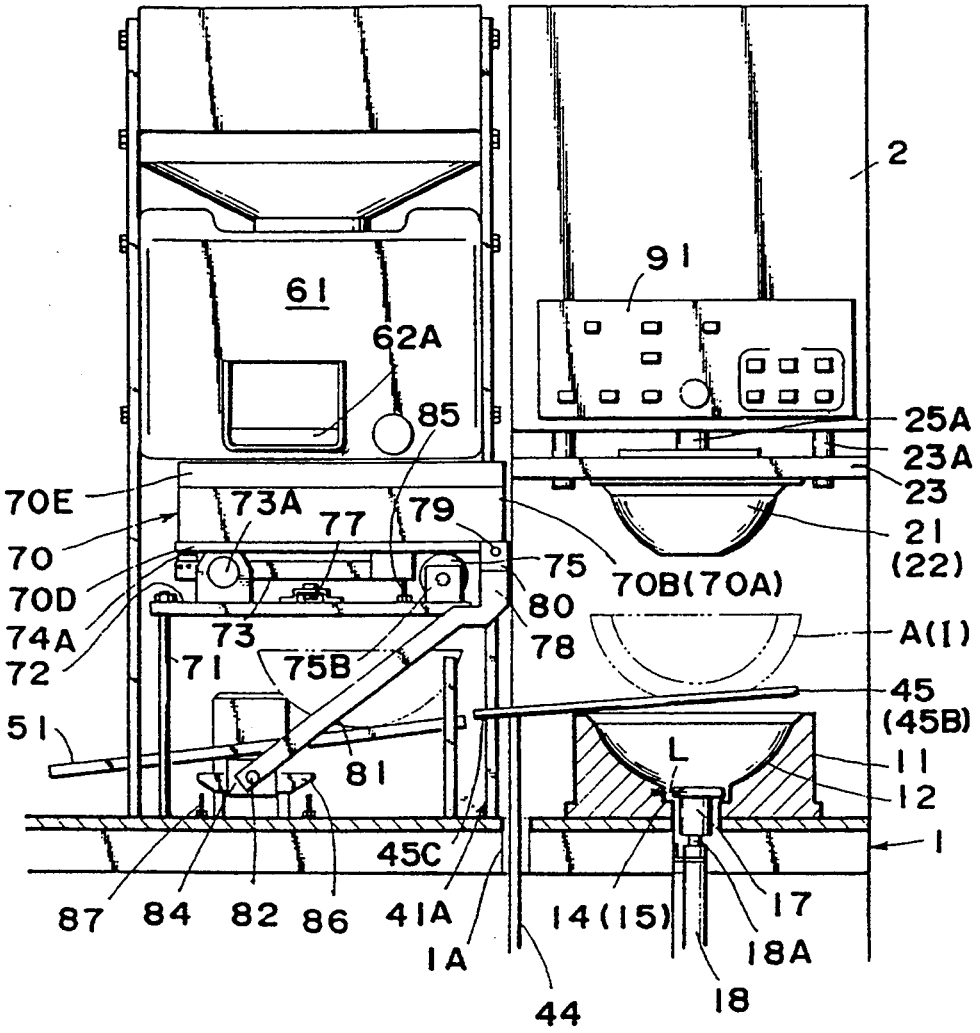
FIG. 8 is a sectional view showing the second embodiment of the present invention.
Figure 9:
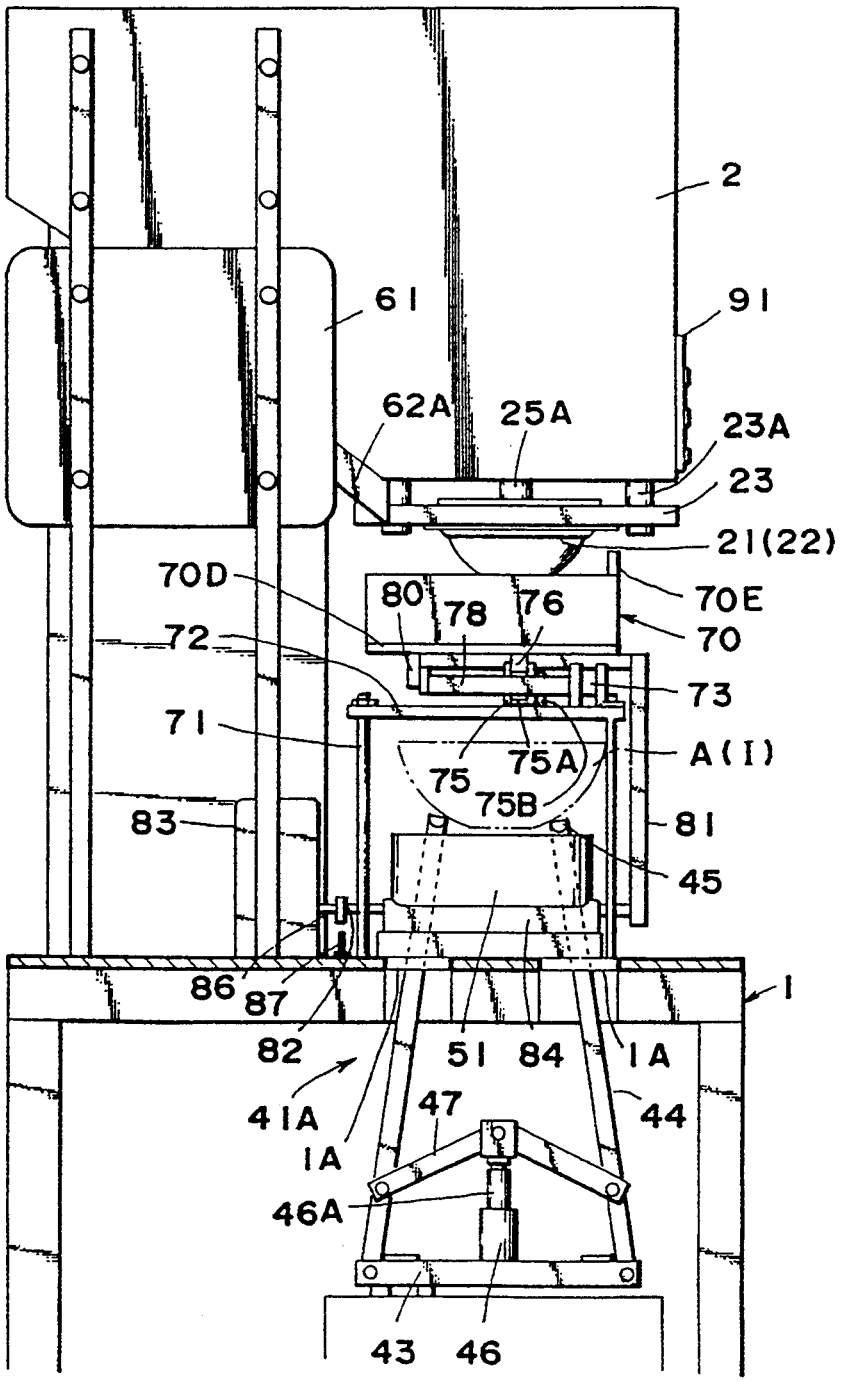
FIG. 9 is a side view showing the second embodiment of the present invention.

The structure of the carrier arm 41A is shown as an inverted form of the carrier arm 41 described in the first embodiment, as shown in FIGS. 6 to 7, wherein the lower ends of pendulous arms 44 positioned fore and aft penetrate through holes 1A formed in the base frame 1. To the upper end of the pendulous arms 44 are connected holding arms 45 extending toward the female die 11 respectively. The holding arms 45 are obliquely provided so that one end 45B of each holding arm 44 is kept higher than the other end 45C which leads to the transporting outlet chute 51. In order to move the pendulous arms 44 toward and away from each other, air pressure cylinder device 46 is, as shown in FIG. 9, perpendicularly mounted on said movable frame 43 with its rod 46A rotatably connected to one end of each of the interlocking arms 47, and the other end of each rotatably connected to the pendulous arms 44, respectively. Automatic ice crusher 61 is placed in the back part of said horizontal plate 72 so as to supply said chute box 70 with ice pieces I. The ice supply port 62A of the automatic ice crusher 61 is provided above the left part of the aperture of chute box 70, as shown in FIG. 6. Further, there is provided an operating panel 91 on upper frame 2.

Now the action of the apparatus having the described structure will be explained. When a starting switch on the operating panel 91 is turned on, ice pieces I are fed from the ice supplying port 62 into the left part of chute box 70. Sequential filling of ice pieces I into the chute box 70 causes the weight in chute box 70 to generally increase. This causes chute box 70 to rotate clockwise around shaft 73B together with lever 73.

Proximity detector 77 is actuated to detect the presence of sufficient ice pieces charged in chute box 70, so that the automatic ice crusher 61 stops supplying ice pieces I.

The actuation of the proximity detector 77 allows air pressure cylinder 83 to work, which causes rotation shaft 82 to rotate together with rocking arm 81, so that chute box 70 is pulled out and inclined toward female die 11 with bar 76 sliding on roller 75. Consequently, as shown in FIG. 7, door 70B is opened to feed ice pieces 1 from outlet port 70A into the hemispherical concave portion 12 of female die 11.

Thereafter, reverse actuation of said air pressure cylinder device 83 allows the chute box 70 to return to the initial position. The proximity detector 77 detects the chute box 70 being empty so as to be fed with ice pieces I from ice supply port 62A in preparation for the next production run.

Approximately at the same time, the male die 21 is lowered by means of air pressure cylinder device having rod 25A so as to form the ice pieces I fed into the hemispherical concave portion 12 into ice vessel A. After the ice vessel A is formed, and rod 25A is raised together with male die 21 by means of the air pressure cylinder device. The air pressure cylinder device 18 is actuated to extend rod 18A so that ice vessel A may be raised over female die 11 by pushing-out pin 17. Thereafter, air pressure cylinder device 46 is actuated to extend rod 46A so as to narrow the distance between a pair of holding arms 45. Further, after above-described steps, the backward movement of rod 46A caused by air pressure cylinder device 46 permits the ice vessel A to be placed on a pair of narrowed holding arms. As the holding arms 45 are inclined, the ice vessel A placed on a pair of holding arms 45 slides down until it reaches outlet chute 51, which is also inclined suitably enough for the ice vessel A to be transported to a suitable place by its own weight. After one ice vessel A is formed and transported in above-described manner, the distance between the holding arms 45 is widened again in preparation for the next oroduction.

According to above-described action of the present apparatus, ice vessel A is capable of being automatically manufactured and transported. Further, what is distinctly characterized by the present apparatus is that the filling of ice pieces I into female die 11 is ensured because the inclination of said chute box 70 is synchronized to pull-out process thereof.

FIG. 10 illustrates the third embodiment of the present invention, wherein the female die 11 is formed with a plurality of through holes 101, the inner apertures of which are provided in hemispherical concave portion 12, and with the outer aperture of the through holes 101 connected to one end of pipe 102. To the other end of the pipe 102 is connected an automatic switching valve 103, such as an electromagnetic valve. To the automatic switching valve 103 is connected tank 104 charged with liquid nitrogen or the like.

When air pressure cylinder device 18 is actuated to raise said ice vessel A so that ice vessel A may be taken out of female die 11, the automatic switching valve 103 is opened so as to blow liquid nitrogen into the clearance between ice vessel A and female die 11 causing liquid nitrogen to be ejected through the through holes 101 toward ice vessel A, and then vaporized. Consequently, the vaporization causes the ice vessel A to be so firmly frozen that ice pieces I become integrally hardened. Accordingly ice vessel A is capable of being smoothly taken out of female die 11 without being broken.

This invention is not be limited to these embodiments described above, and can be varied within the scope of the invention.

For example, carrier arm of the first embodiment may be tabular instead of arm-type. The upper portion of supporting section 31F, which is vertically provided and fixed to said slide plate 31A, may be connected by shaft 3B to supporting rod 3A of side frame 3 so that the supporting section 31F may be suspended and be only rotated within a predetermined angle range. Further, air pressure cylinder devices of the embodiments may be replaced by hydraulic cylinders or electronic motors used as driving means. Moreover, dry ice may be used instead of liquid nitrogen in the third embodiment of FIG. 10. Furthermore, hemispherical concave and convex portions of the female and male die may be provided with cloth members, to which may be applied food color so as to color the ice vessels.

What is claimed:

1. An apparatus for producing ice vessels for use in serving fresh foods therein comprising:

a female die;

a male die opposite to said female die for cooperating with said female die to define a mold cavity for forming said ice vessels;

a through-hole formed at the bottom of said female die;

a pushing-out pin which is raised and lowered in said through-hole by an elevator device;

an automatic ice crusher for producing ice pieces;

a chute box located for feeding the ice pieces from said automatic ice crusher into said female die, said chute box having an outlet located above said female die, and an inlet located below said ice crusher for receiving the ice pieces therefrom;

a transporting outlet chute for transporting the molded ice vessels, said outlet chute being inclined for permitting the molded ice vessels to slide thereon; and a carrier-arm device provided above said female die, said carrier-arm device being movable back and forth to transport the molded ice vessels from said mold cavity to said transporting outlet chute;

said carrier-arm device having holding arms capable of moving toward and away from each other above the sides of said female die, and said chute box being movable in a synchronized manner with respect to the transporting of said molded ice vessels to have its outlet directed for feeding ice into said female die upon removal of an ice vessel therefrom; and one end of said holding arms being elevated to a position higher than the other end, whereby said holding arms are inclined at approximately the same angle as the angle of said outlet chute, thereby allowing said molded ice vessels to slide from said holding arms onto said outlet chute.

2. An apparatus for producing ice vessels for use in serving fresh food therein according to claim 1, wherein said chute box is inclinable for feeding ice through its out,let into said female die in a manner synchronized to feed said ice upon removal of an ice vessel being removed from said female die.

* * * * *